United States Patent [19]

Kruse et al.

[11] Patent Number: 4,765,248

[45] Date of Patent: Aug. 23, 1988

[54] LIMITED RANGE, ARROW STABILIZED SUBCALIBER PROJECTILE FOR A TUBULAR WEAPON

[75] Inventors: Heinz-Josef Kruse, Ratingen; Ulrich Theis, Kuhlendahl; Klaus D. Pahnke, Solingen; Peter Wallow; Wilfried Becker, both of Düsseldorf, all of Fed. Rep. of Germany

[73] Assignee: Rheinmetall GmbH, Düsseldorf, Fed. Rep. of Germany

[21] Appl. No.: 41,376

[22] Filed: Apr. 23, 1987

[30] Foreign Application Priority Data

Apr. 24, 1986 [DE] Fed. Rep. of Germany ..... 3613866

[51] Int. Cl.[4] ..... F42B 13/205

[52] U.S. Cl. ..... 102/529; 244/3.23

[58] Field of Search ..... 102/498, 529; 244/3.23, 244/3.24

[56] References Cited

U.S. PATENT DOCUMENTS

| | | | |
|---|---|---|---|
| 4,195,573 | 4/1980 | Leeker et al. | 102/520 |
| 4,242,960 | 1/1981 | Boeder et al. | 102/529 X |
| 4,334,478 | 6/1982 | Goes et al. | 102/529 |
| 4,413,566 | 11/1983 | Loeb et al. | 102/529 X |
| 4,519,316 | 5/1985 | Bethmann et al. | 102/513 |
| 4,520,972 | 6/1985 | Diesinger et al. | 102/529 X |
| 4,653,405 | 3/1987 | Paine | 102/529 |

FOREIGN PATENT DOCUMENTS

| | | | |
|---|---|---|---|
| 1405329 | 9/1975 | European Pat. Off. . | |
| 0154762 | 9/1985 | European Pat. Off. . | |
| 2527764 | 12/1983 | France | 102/529 |

*Primary Examiner*—Ted L. Parr

*Attorney, Agent, or Firm*—Spencer & Frank

[57] ABSTRACT

A subcaliber projectile intended for arrow stabilization has its guide assembly set so that the projectile spins around its longitudinal axis and is constructed so that it is unbalanced with respect to its longitudinal axis such that the spinning reaches a critical number of revolutions at a given time during the trajectory of the projectile and the resulting resonance causes destruction of the projectile.

6 Claims, 3 Drawing Sheets

LIMITED RANGE, ARROW STABILIZED SUBCALIBER PROJECTILE FOR A TUBULAR WEAPON

BACKGROUND OF THE INVENTION

The present invention relates to a subcaliber arrow shaped stabilized projectile having a limited range so as, for example, to render the projectile ineffective after a missed target or limit the flight of the projectile to a test range.

A projectile of the above type is disclosed in Federal Republic of Germany Patent No. 2,747,313 which corresponds to U.S. Pat. No. 4,195,573, issued Apr. 1st, 1980. This projectile has bores in its resistance stabilizing, conical tail section, with these bores being arranged parallel to the longitudinal axis of the projectile and being each designed to converge-diverge to form supersonic diffusers (perforated cone tail section). This known prior art projectile is distinguished by reliable range limitation, and is particularly suitable for calibers customarily employed in armored cannons. However, in a caliber range reserved for automatic cannons, the bores in the tail section can no longer be designed to produce a sufficiently reliable range limitation for the projectile.

SUMMARY OF THE INVENTION

It is an object of the invention to provide a subcaliber arrow stabilized projectile of limited range which is also suitable for the caliber range reserved for automatic cannons.

The above object is achieved according to the present invention in that in a limited range, arrow stabilized subcaliber projectile for a tubular weapon, including a columnar or cylindrical main body portion having a stabilizing tail section which is secured to the main body portion and has a larger outer diameter than the diameter of the main body portion; the stabilizing tail section includes means for causing the projectile to spin, i.e., rotate, about its longitudinal axis during flight; and means, which are disposed on the outer surface of the main body portion and extend parallel to the projectile longitudinal axis, are provided for producing an unbalance of the projectile with respect to its longitudinal axis so that at a given moment in time, and thus after the projectile has covered a corresponding distance on its trajectory, the spinning or rotating rate corresponds to a critical number of revolutions which produces resonance in the projectile leading to the self-destruction of the projectile.

According to features of the invention, the unbalance may be produced by an elongated recess or projection formed on the peripheral surface of the main body portion and extending parallel to the longitudinal axis of the projectile. Moreover, the stabilizing tail section preferably comprises a plurality of fins symmetrically disposed about the circumference of the projectile, with the rotation or spin of the projectile being imparted by appropriately positioned inclined partial side surfaces of the fins.

The present invention provides the advantage that both small and large caliber projectiles of the same type can be realized at comparatively little expense.

As can be seen from the above, the essence of the invention is that a subcaliber arrow stabilized projectile is caused to self-destruct after a predetermined time from firing, that is, at a predetermined distance from the weapon by causing the projectile to spin or rotate about its longitudinal axis and subsequently to resonate (parallel to a plane perpendicular to its trajectory) when the projectile reaches a predetermined spinning speed. In order to cause such resonance, which causes the projectile to self-destruct and thus render it harmless, the projectile is constructed so that it is unbalanced with regard to its longitudinal axis.

The invention will be described in greater detail below with reference to an embodiment thereof which is schematically illustrated in the drawings.

DETAILED DESCRIPTION OF THE PREFERRED EMBODIMENTS

Figure 1:
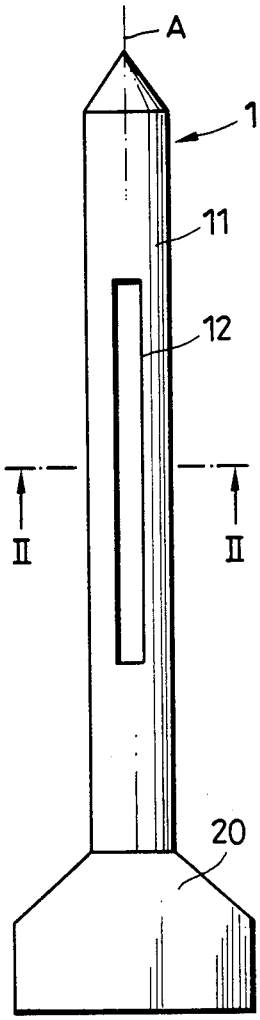
FIG. 1 is a schematic side elevational view of a projectile according to the invention.
Figure 2:
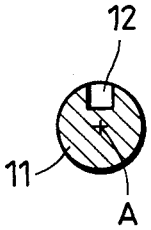
FIG. 2 is a sectional view along line II—II of FIG. 1.

Referring now to FIGS. 1 and 2, there is shown a subcaliber arrow projectile 10 having a columnar or cylindrical main body portion 11 and a stabilizing tail portion or guide assembly 20. The main body portion 11 is provided with a narrow elongated recess or groove 12 in its peripheral or outer surface, with the recess extending parallel to the longitudinal axis A of the projectile 10. This recess 12, which, for the sake of clarity, is shown at a very large scale, constitutes an imbalance of the projectile 10 with regard to the axis A. The tail portion or guide assembly 20, which is rigidly connected to the body portion 11, is constructed so as to cause the projectile 10 to spin or rotate about its longitudinal axis A, and the dimensions of the recess 12 are selected so as to cause the projectile 10 to resonate at a predetermined spinning speed or rate of rotation, and to break at a point or area of structural weakness. Such a point of structural weakness results, for example, from the circumferential thread or other form locking means (not illustrated) conventionally provided on such subcaliber projectiles for interaction with corresponding means for the detachable sabot required for such projectiles, as shown, for example, in the above mentioned U.S. Pat. No. 4,195,593.

Figure 3:
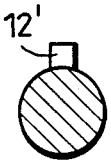
FIG. 3 is a sectional view, analogous to that of FIG. 2, but showing a modified arrangement for producing unbalance of the projectile according to the invention.

Although the imbalance is provided by a recess or groove 12 according to the preferred embodiment of the invention as shown in FIG. 2, it is to be understood that the imbalance may be provided in other ways so long as it produces the desired resonance at the predetermined spinning rate or speed. For example, the imbalance may be provided by an elongated protrusion 12' as shown in FIG. 3 which is formed on the peripheral surface of the portion 11 and extends, in a manner similar to that of recess 12, parallel to the longitudinal axis A.

As mentioned above, the tail section or guide assembly 20 must impart a rotation to the projectile 10 about its longitudinal axis A. Preferably this is achieved by providing a tail section 20 what is comprised of a plurality of fins, for example, six fins, which are disposed symmetrically around the circumference of the projectile and which are provided with inclined partial side surfaces oriented to produce the desired rotation during flight of the projectile 10. A preferred exemplary embodiment of one such fin is shown in FIGS. 4–6.

Figure 5:
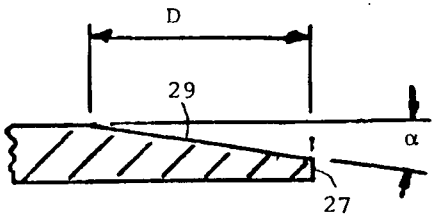
FIG. 5 is a sectional view along lie V—V of FIG. 4.
Figure 4:
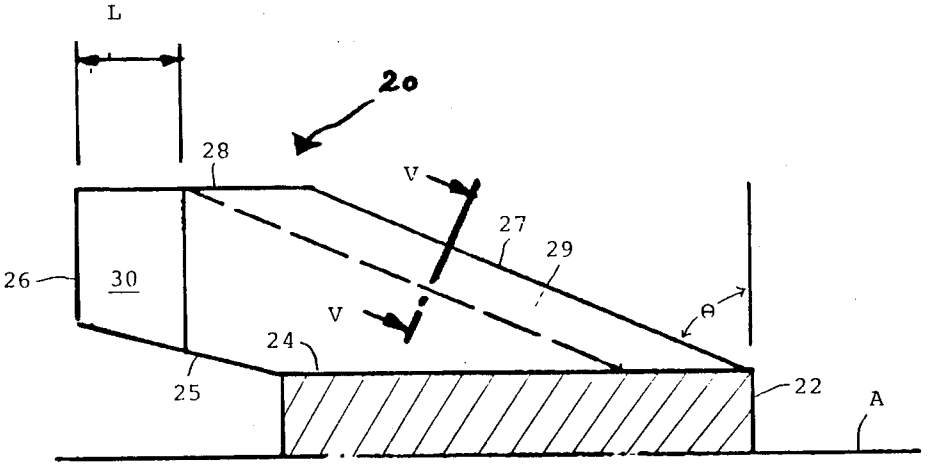
FIG. 4 is a side elevation view showing an example of one fin of the guide assembly 20 for imparting a spin to the projectile.
Figure 6:
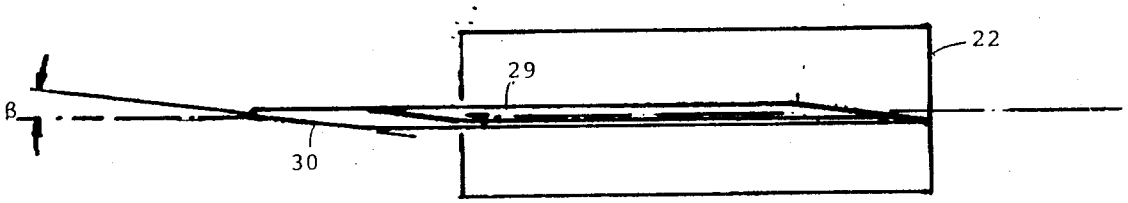
FIG. 6 is a top view of the fin of FIG. 4.

As shown in FIGS. 4–6 each fin is formed on the peripheral surface of a sleeve 22 having the same outer diameter as the main body portion 11 (FIG. 1) and which is securely connected to the body portion 11. Each of the fins has a lower edge portion 24 which is fastened to the surface of the sleeve 22 and extends parallel to the axis A. The remainder of the lower edge of the fin is formed by a lower edge portion 25 which extends rearwardly from the trailing end of the portion 24 with an upward inclination with respect to the axis A to the rear edge 26 of the fin, which edge 26 extends perpendicular to the axis A. The upper edge of each fin includes a first inclined portion 27 which rearwardly extends from the leading edge of the fin at an inclination angle Θ with respect to a perpendicular to the axis A until it reaches the outer diameter of the tail section of the projectile, i.e., the bore diameter of the weapon, and a further rearwardly extending portion 28 which extends parallel to the axis A. One of the major surfaces of each fin, i.e., the back surface of the fin as shown in FIG. 4, is provided with an inclined surface portion 29 along the leading portion of its upper edge. The surface portion 29 forms an angle $\alpha$ with the upper edge portion 27 and extends for a depth D from the edge portion 27 as shown in FIG. 5. Finally, the other major surface of each fin, i.e., the front surface as shown in FIG. 4, is provided with an inclined partial surface 30 which extends from the rear edge 26 forwardly for a length L and encloses an angle $\beta$ with the axis A. Due to the air striking the inclined partial surfaces, particularly the partial surface 29, during flight of the projectile, a rotation or spinning of the projectile 10 about the longitudinal axis A will be produced.

Figure 7:
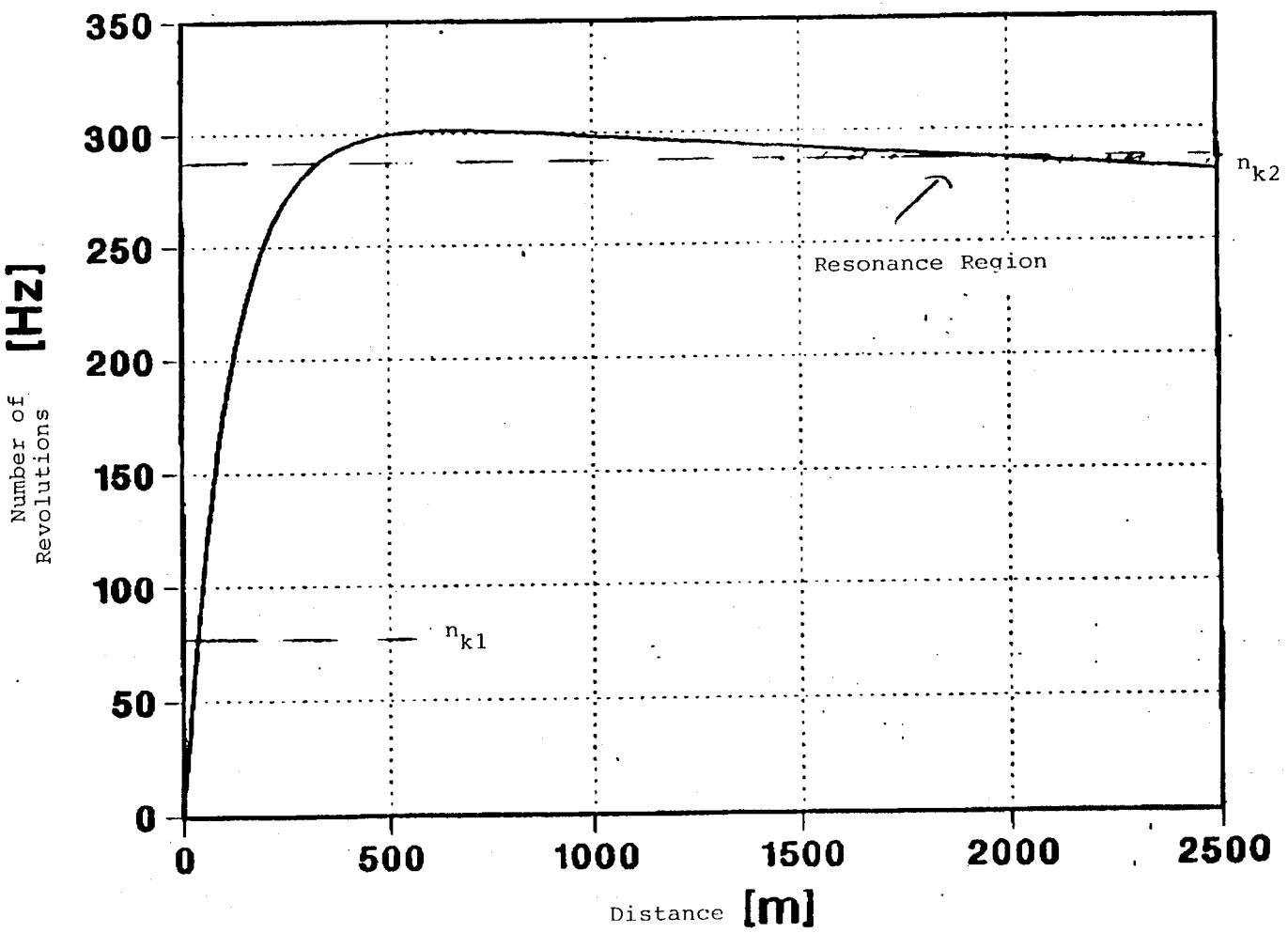
FIG. 7 is a graph showing the number of revolutions verses the distance travelled for one embodiment of a projectile according to the invention.

When a subcaliber projectile 10 according to the invention is fired, the projectile looses its sabot (not shown) after leaving the gun barrel, and is quickly brought by its stabilizing tail section or guide assembly 20 to a high number of revolutions around the longitudinal axis A of the projectile. During this initial rapid rise in spinning rate, as shown, for example in FIG. 7, the spin rate passes through a lower critical number of revolutions value $n_{k1}$ and through the upper or desired critical number of revolutions value $n_{k2}$. However, as shown, the lower and upper critical values $n_{k1}$ and $n_{k2}$, respectively exist for only such a short time that no resonance can develop. However, after the rapid rise in the number of revolutions has reached its maximum value, the value then decreases slightly and approaches the upper critical value $n_{k2}$ and, as shown, remains at this upper critical value for a time sufficient to produce the resonance which subsequently destroys the subcaliber projectile 10, for example by breaking same at the area provided for the connection to the sabot.

The table below is based on a comparison of two different projectiles constructed according to the invention.

| | for an automatic cannon | for an armored cannon |
|---|---|---|
| gun caliber (mm) | 30 | 120 |
| projectile weight (kg) | 0.4 | 4 |

-continued

| | for an automatic cannon | for an armored cannon |
|---|---|---|
| projectile body | | |
| diameter (mm) | 12 | 27 |
| length (mm) | 200 | 500 |
| modulus of elasticity (MPa) | 450.000 | 450.000 |
| critical number of revolutions (Hz) | | |
| lower value $n_{k1}$ | 225 | 76 |
| upper value $n_{k2}$ | 849 | 287 |

Moreover, according to a specific embodiment of a projectile 10 for an armored cannon having the parameters listed above and having a tail section or guide assembly as shown in FIGS. 4–6 with six fins, the recess 12 has a length of 250 mm, a width of 3 mm and a depth of 4 mm, to provide an unbalance of 0.52 kgmm. Moreover in the fin arrangement of FIGS. 4–6, the angle $\Theta=65°$, the angles $\alpha$ and $\beta$ are each 9°, the depth D is 8 mm, and the length L is 20 mm.

It will be understood that the above description of the present invention is susceptible to various modifications, changes and adaptations, and the same are intended to be comprehended within the meaning and range of equivalents of the appended claims.

What is claimed is:

1. In a limited range, arrow stabilized subcaliber projectile for a tubular weapon, including a cylindrical main body portion having a stabilizing tail section which is secured to said main body portion and has a larger outer diameter than the diameter of said main body portion; the improvement wherein:

said stabilizing tail section includes means for causing said projectile to rotate about its longitudinal axis during flight; and said main body portion further includes means, extending parallel to said longitudinal axis along the peripheral surface of said main body portion, for producing an unbalance of said projectile with respect to its said longitudinal axis so that at a given moment in time, and thus after projectile has covered a corresponding distance on its trajectory, the rotation rate corresponds to a critical number of revolutions which produces resonance in said projectile to cause the breaking apart and the self-destruction of said projectile.

2. The subcaliber projectile defined in claim 1 wherein said means for producing an unbalance comprise an elongated recess formed in the peripheral surface of said main body portion and extending parallel to said longitudinal axis of said projectile.

3. The subcaliber projectile defined in claim 2 wherein said stabilizing tail section includes a plurality of fins symmetrically disposed about the circumference of said projectile; and said means for causing said projectile to rotate includes at least one inclined partial side surface on each of said fins.

4. The sub-caliber projectile defined in claim 1 wherein said means for producing an unbalance comprises an elongated projection formed on the peripheral surface of said main body portion and extending parallel to said longitudinal axis of said projectile.

5. The subcaliber projectile defined in claim 4 wherein said stabilizing tail section includes a plurality of fins symmetrically disposed about the circumference of said projectile; and said means for causing said projectile to rotate includes at least one inclined partial side surface on each of said fins.

6. The sub-caliber projectile defined in claim 1 wherein said stabilizing tail section includes a plurality of fins symmetrically disposed about the circumference of said projectile; and said means for causing said projectile to rotate includes at least one inclined partial side surface on each of said fins.

* * * * *